US009677186B2

(12) United States Patent
Braun et al.

(10) Patent No.: US 9,677,186 B2
(45) Date of Patent: Jun. 13, 2017

(54) BIPOLAR ELECTROCHEMICAL PRINTING

(71) Applicant: University of Washington, Seattle, WA (US)

(72) Inventors: Trevor Braun, Seattle, WA (US); Daniel T. Schwartz, Seattle, WA (US)

(73) Assignee: University of Washington, Seattle, WA (US)

( * ) Notice: Subject to any disclaimer, the term of this patent is extended or adjusted under 35 U.S.C. 154(b) by 0 days.

(21) Appl. No.: 14/666,554

(22) Filed: Mar. 24, 2015

(65) Prior Publication Data

US 2015/0267311 A1 Sep. 24, 2015

Related U.S. Application Data

(60) Provisional application No. 61/969,664, filed on Mar. 24, 2014.

(51) Int. Cl.

| | |
|---|---|
| ***C25D 17/12*** | (2006.01) |
| ***C25D 5/02*** | (2006.01) |
| *C25D 3/12* | (2006.01) |
| *C25D 3/38* | (2006.01) |

(52) U.S. Cl.

CPC ..... *C25D 5/026* (2013.01); *C25D 17/12* (2013.01); *C25D 3/12* (2013.01); *C25D 3/38* (2013.01)

(58) Field of Classification Search

CPC ..... C25D 17/12

See application file for complete search history.

(56) References Cited

U.S. PATENT DOCUMENTS

| | | | | |
|---|---|---|---|---|
| 4,403,234 | A * | 9/1983 | Miura | B41J 2/06 346/47 |
| 5,641,391 | A | 6/1997 | Hunter | |
| 6,120,669 | A | 9/2000 | Bradley | |
| 6,132,586 | A * | 10/2000 | Adams | H01L 21/7684 205/123 |
| 6,495,005 | B1 * | 12/2002 | Colgan | C25D 7/12 204/196.15 |
| 6,770,320 | B2 * | 8/2004 | Yamauchi | B05C 5/0216 118/677 |
| 7,615,141 | B2 | 11/2009 | Schwartz | |
| 7,628,902 | B2 | 12/2009 | Knowlton | |
| 7,955,486 | B2 | 6/2011 | Yu | |

(Continued)

OTHER PUBLICATIONS

Bradley, J.-C., et al., "Creating Electrical Contacts Between Metal Particles Using Directed Electrochemical Growth," Nature 389(6648):268-271, Sep. 1997.

(Continued)

*Primary Examiner* — Stefanie S Wittenberg

(74) *Attorney, Agent, or Firm* — Christensen O'Connor Johnson Kindness PLLC

(57) ABSTRACT

A bipolar electrochemistry printer and method are disclosed wherein electrolytic deposition onto a conductive substrate is accomplished by inducing ionic current in an electrolytic cell disposed above the substrate to undergo charge transfer at the conductive substrate, such that a portion of the substrate becomes a bipolar electrode. The ohmic current in the substrate undergoes a second charge transfer back to ionic current and returning to the cathode of the electrolytic cell. In an alternative embodiment the printing is similarly accomplished by electrolytic etching.

10 Claims, 5 Drawing Sheets

(56) References Cited

U.S. PATENT DOCUMENTS

| | | | | |
|---|---|---|---|---|
| 8,701,471 | B2 | 4/2014 | O'Donnell | |
| 2006/0163759 | A1* | 7/2006 | Maruyama | B05C 5/02 261/137 |
| 2007/0089993 | A1 | 4/2007 | Schwartz | |

OTHER PUBLICATIONS

Bradley, J.-C., et al., "Programmable Hard-Wiring of Circuitry Using Spatially Coupled Bipolar Electrochemistry," Journal of the Electrochemical Society 146(1):194-198, Jan. 1999.

Braun, T.M., and D.T. Schwartz, "Contactless Electrodeposition and Micropatterning via Bipolar Electrochemical Printing," 224th Electrochemical Society Meeting, Abstract No. 2361, Oct. 2013,1 page.

Chow, K.-F., et al., "A Large-Scale, Wireless Electrochemical Bipolar Electrode Microarray," Journal of the American Themical Society 131(24):8364-8365, May 2009.

Chow, K.-F., et al., "Wireless Electrochemical DNA Microarray Sensor," Journal of the American Chemical Society 130(24):7544-7545, Jun. 2008.

Fosdick S.E., et al., "Parallel Screening of Electrocatalyst Candidates Using Bipolar Electrochemistry," Analytical Chemistry 85(4):2493-2499, Feb. 2013.

Fosdick, S.E., and R.M. Crooks, "Bipolar Electrodes for Rapid Screening of Electrocatalysts," Journal of the American Chemical Society 134(2):863-866, Dec. 2011.

Ishiguro, Y., et al., "Gradient Doping of Conducting Polymer Films by Means of Bipolar Electrochemistry," Langmuir 27(11):7158-7162, May 2011.

Loget, G., and A. Kuhn, "Electric Field-Induced Chemical Locomotion of Conducting Objects," Nature Communications 2:535, Nov. 2011, 6 pages.

Loget, G., et al., "Indirect Bipolar Electrodeposition," Journal of the American Chemical Society 134:20033-20036, Nov. 2012.

Loget, G., et al., "True Bulk Synthesis of Janus Objects by Bipolar Electrochemistry," Advanced Materials 24(37):5111-5116, Jul. 2012.

Nelson, J.B, "Electrochemical Printing: Design, Characterization, and Translation," doctoral dissertation, University of Washington, Seattle, Washington, 2007,135 pages.

Nelson, J.B., and D.T. Schwartz, "Characterization of Buffered Electrolytes for Nickel Electrochemical Printing," Journal of the Electrochemical Society 155(3):D181-D186, Feb. 2008.

Nelson, J.B., et al., "Electrochemical Printing: Mass Transfer Effects," Journal of Micromechanics and Microengineering 17:1192-1199, May 2007.

Nelson, J.B., and D.T. Schwartz, "Electrochemical Factors Controlling the Patterning of Metals on SAM-Coated Substrates," Langmuir 23(19):9661-9666, Sep. 2007.

Nelson, J.B., and D.T. Schwartz, "Electrochemical Printing: In Situ Characterization Using an Electrochemical Quartz Crystal Microbalance," Journal of Micromechanics and Microengineering 15(12):2479-2484, Nov. 2005.

Ramakrishnan, S., and C. Shannon, "Display of Solid-State Materials Using Bipolar Electrochemistry," Langmuir 26(7):4602-4606, Mar. 2010.

Ulrich, C., et al., "Formation of Molecular Gradients on Bipolar Electrodes," Angewandte Chemie—International Edition 47:3034-3036, Mar. 2008.

Whitaker, J.D., "Electrochemical Printing," doctoral dissertation, University of Washington, Seattle, Washington, 2003, 128 pages.

Whitaker, J.D., et al., "Electrochemical Printing: Software Reconfigurable Electrochemical Microfabrication," Journal of Micromechanics and Microengineering 15(8):1498-1503, Jun. 2005.

* cited by examiner

BIPOLAR ELECTROCHEMICAL PRINTING

CROSS-REFERENCE TO RELATED APPLICATION

This application claims the benefit of Provisional Application No. 61/969,664, filed Mar. 24, 2014, the disclosure of said application is hereby incorporated by reference herein.

STATEMENT OF GOVERNMENT LICENSE RIGHTS

This invention was made with Government support under grant No. P200A120023 awarded by Department of Education. The Government has certain rights in the invention.

BACKGROUND

Electrochemical printing systems have been designed that are particularly suited to the manufacture of components for micro-electromechanical systems. For example, in U.S. Pat. No. 7,615,141, to Schwartz et al., which is hereby incorporated by reference in its entirety, an electrochemical micro-manufacturing system and method is disclosed that has a printer head that expels a jet of electrolyte towards a conductive substrate to facilitate electrochemical deposition onto the substrate or removal of material from the substrate. The electrochemical printing system disclosed in Schwartz applies a current or voltage across the electrode and the conductive substrate to deposit a material thereon using well-known electrolytic deposition processes.

However, in many applications it is desirable to electrochemically deposit a material onto a substrate without connecting the substrate directly to an electrochemical system. For example, it may be desirable to deposit (or etch) a large plurality of items without having to individually apply suitable attachment means to permit conventional electrodeposition onto the item.

Bipolar electrochemistry involving spatially segregated, equal and opposite reduction and oxidation on an electrically floating conductor, is an area of electrochemistry that has gained increasing attention in recent years. The driving force for bipolar electrochemistry is the ohmic potential variation in solution that forms during the passage of current in an electrochemical cell. When there is an appreciable ohmic potential drop through solution, and a conductor is in that potential gradient, the path of least resistance for current flow can sometimes be through the conductor via bipolar electrochemistry.

Electrochemical deposition and electrochemical etching processes are among the areas of active research in this new breed of engineering-oriented bipolar electrochemistry applications. For example, in U.S. Pat. No. 6,120,669, to Bradley, which is hereby incorporated by reference in its entirety, a bipolar electrochemical process for growing metal interconnects or wires between electrically isolated spheres or other particles using spatially coupled bipolar electrochemistry is disclosed. However, the system disclosed in Bradley is not suitable for precision electrodeposition of materials onto a conductive substrate, or precision etching of materials from a conductive substrate.

SUMMARY

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

A bipolar electrochemical printer head for printing, etching, or otherwise modifying a conductive substrate includes a tubular nozzle defining a channel having an inlet configured to be connected to a source of electrolyte and an outlet configured to be supported over the conductive substrate. A housing attached to the nozzle has a lower end that surrounds and extends away from the nozzle. A first electrode (anode or cathode) and a second electrode (the other of anode and cathode) are arranged with the first electrode in fluid communication with the channel and the second electrode supported on the housing and spaced from the nozzle. A power supply connects the first and second electrodes. The second electrode is positioned to fluidly engage a meniscus of electrolyte expelled from the channel onto the substrate such that the electrolyte closes a circuit between the first and second electrodes and the power supply.

In an embodiment, the lower end of the housing is disposed at an elevation above the channel outlet, for example, less than 3 mm above the channel outlet.

In an embodiment the first electrode is an anode, and the second electrode is a cathode, and the second electrode defines a substantially circular loop that is centered on the channel. For example, the channel outlet may be circular, with an exit diameter and the wall of the tubular nozzle may have a thickness that is greater than the exit diameter. In an embodiment the exit diameter is less than 1 mm, and the wall thickness is less than 3 mm. In another embodiment the exit diameter is at least 200 microns and the wall thickness is at least 240 microns.

In an embodiment the printer head is configured to be positioned over the conductive substrate at a distance that will cause ionic current in the electrolyte to undergo charge transfer at the conductive substrate between the nozzle and the substrate.

A method for electrochemical printing is disclosed that includes providing a conductive substrate, positioning a printer head over the substrate, wherein the printer head includes (i) a tubular nozzle comprising an annular wall defining a channel, wherein the channel has an inlet configured to be connected to a source of electrolyte and an outlet configured to be supported in spaced relation over the conductive substrate, (ii) a housing attached to the nozzle having a lower end that surrounds and extends away from the nozzle, (iii) a first electrode comprising one of an anode and a cathode, and a second electrode comprising the other of the anode and the cathode, wherein the first electrode extends into the channel and the second electrode is supported on the housing and comprises a closed loop surrounding and spaced apart from the tubular nozzle, and (iv) a power supply electrically connecting the first electrode to the second electrode; and flowing an electrolyte into the channel inlet such that the electrolyte electrically contacts the first electrode and expelling the electrolyte from the channel outlet and onto the conductive substrate such that electrolyte expelled from the channel outlet wets the second electrode; wherein expelled electrolyte passing between the conductive substrate and annular wall undergoes charge transfer such that a portion of the conductive substrate functions as a bipolar electrode.

In an embodiment the electrolyte comprises dissolved metal cations, for example copper ions or nickel ions.

In an embodiment a reduction reaction occurs between the electrolyte and the conductive substrate near the outlet, and an oxidizing reaction occurs between the conductive substrate and the electrolyte away from the outlet.

In an embodiment the conductive substrate comprises a metal, a metal oxide, a conductive polymer, or a graphite.

In an embodiment the housing is disposed at an elevation above the channel outlet, for example, less than 3 mm above the channel outlet.

In an embodiment the first electrode is an anode, and the second electrode is a cathode. The cathode may be shaped as a closed loop around the channel.

In an embodiment the channel outlet is circular with an exit diameter that is less than the wall thickness of the tubular nozzle.

DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION

Figure 1A:
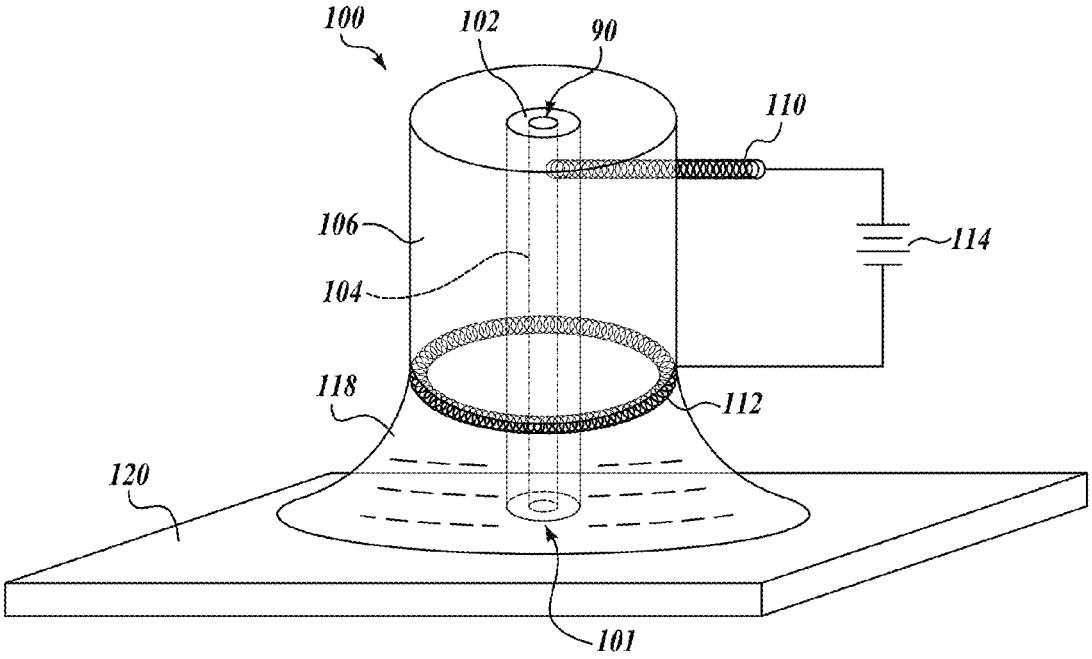
FIG. 1A illustrates schematically a bipolar electrochemical printer head in accordance with the present invention.

The present invention will now be described with reference to the FIGURES which show currently preferred embodiments of a bipolar electrochemical printer, wherein like numbers indicate like parts. A bipolar electrochemical printer 100 in accordance with the present invention is shown schematically in FIG. 1A. In this embodiment the printer modifies and improves upon the electrochemical printer disclosed in U.S. Pat. No. 7,615,141 incorporated by reference above. For clarity and brevity, aspects of the bipolar electrochemical printer 100 disclosed in U.S. Pat. No. 7,615,141 are not repeated here.

The bipolar electrochemical printer 100 includes a nozzle 101 that is supported or suspended above a conductive substrate 120. The nozzle 101 is configured to direct a stream of electrolyte onto the substrate. In this exemplary embodiment the nozzle 101 comprises a tubular member 102 defining an elongate channel 104 therethrough. The elongate channel 104 is connected to a pressurized source of electrolyte, as indicated by arrow 90. An external support or housing 106 extends outwardly from the tubular member 102, and provides a peripheral support that surrounds the nozzle 101. Although in this embodiment the nozzle 101 is supported or suspended above the substrate 120, it is contemplated the printer 100 could be implemented with the nozzle resting directly on the wetted conductive substrate 120.

An anode 110 extends into the tubular member 102 such that electrolyte flowing through the channel 104 is in fluid contact with the anode 110. A cathode 112 extends from a distal end of the housing 106, and is controllably connected to the anode 110 with a power supply 114. The cathode 112 is positioned on the housing 106 at a position such that during printing the cathode 112 contacts or extends through a meniscus of the electrolyte 118 deposited by the nozzle 101 onto the conductive substrate 120. It will be appreciated by persons of skill in the art that the anode 110, electrolyte 118, cathode 112, and power supply 114 as illustrated in FIG. 1A define an electrochemical cell.

Figure 1B:
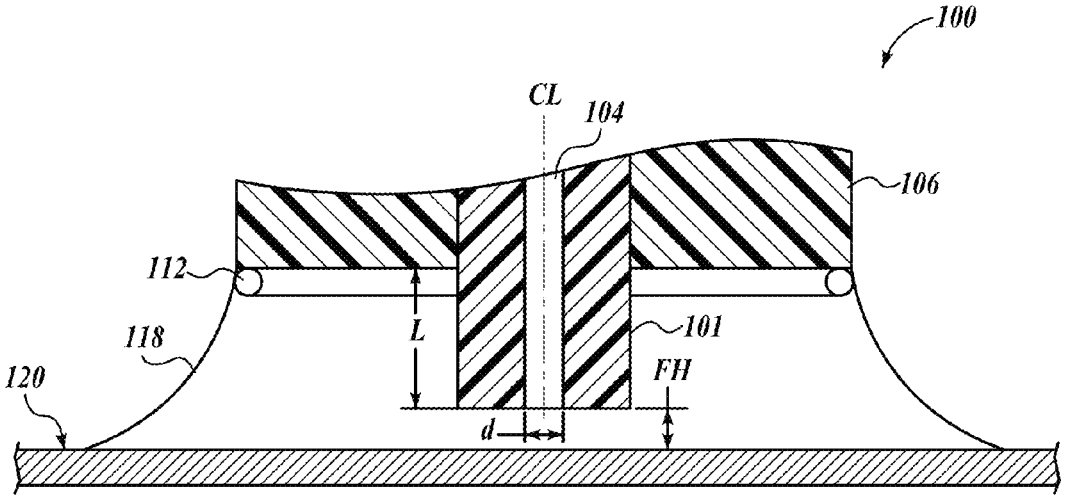
FIG. 1B is a detail view of the printer head shown in FIG. 1A, showing the region near the jet and the substrate, and identifying certain geometric elements.

FIG. 1B is a detail cross-sectional view showing certain geometric parameters of the printer 100 near the nozzle 101 outlet. The length L is the vertical distance the nozzle 101 extends from the housing 106 (or top of cathode 112). In a current embodiment this length L is set at 1 mm. However other lengths are contemplated by the present invention, and may be determined by persons of skill in the art. The length L is selected to facilitate electrolyte 118 wetting or immersing the feeder cathode 112 to thereby complete the circuit of the electrochemical cell. In some embodiments length L may be in a range between 0.1 mm and 3.0 mm, for example.

The nozzle channel 104 exit diameter d is also shown in FIG. 1B. In a current embodiment the tubular member 102*a* comprises a fused silica tube having an inside diameter of 200 μm and a wall thickness of 240 μm. In some embodiments it is contemplated that the nozzle 101 exit diameter d may be in a range between 100 nm and 1 mm or larger, for example, and the wall thickness may be in a range between 200 nm and 1 cm or larger.

The nozzle 101 is supported above the substrate 120 a fly-height distance FH. The fly-height FH may be readily controlled either by controlling the position of the printer 100 or by controlling the position of the substrate 120. The lateral position of the nozzle 101 may also be controlled in a similar manner. In a current embodiment FH is controlled by supporting the substrate 120 on a 3-axis actuator (not shown) with a minimum step-size of 3 μm. Other mechanisms for positional control of the printer 100 and/or the substrate 120 are well known in the art, and are contemplated herein.

Figure 1C:
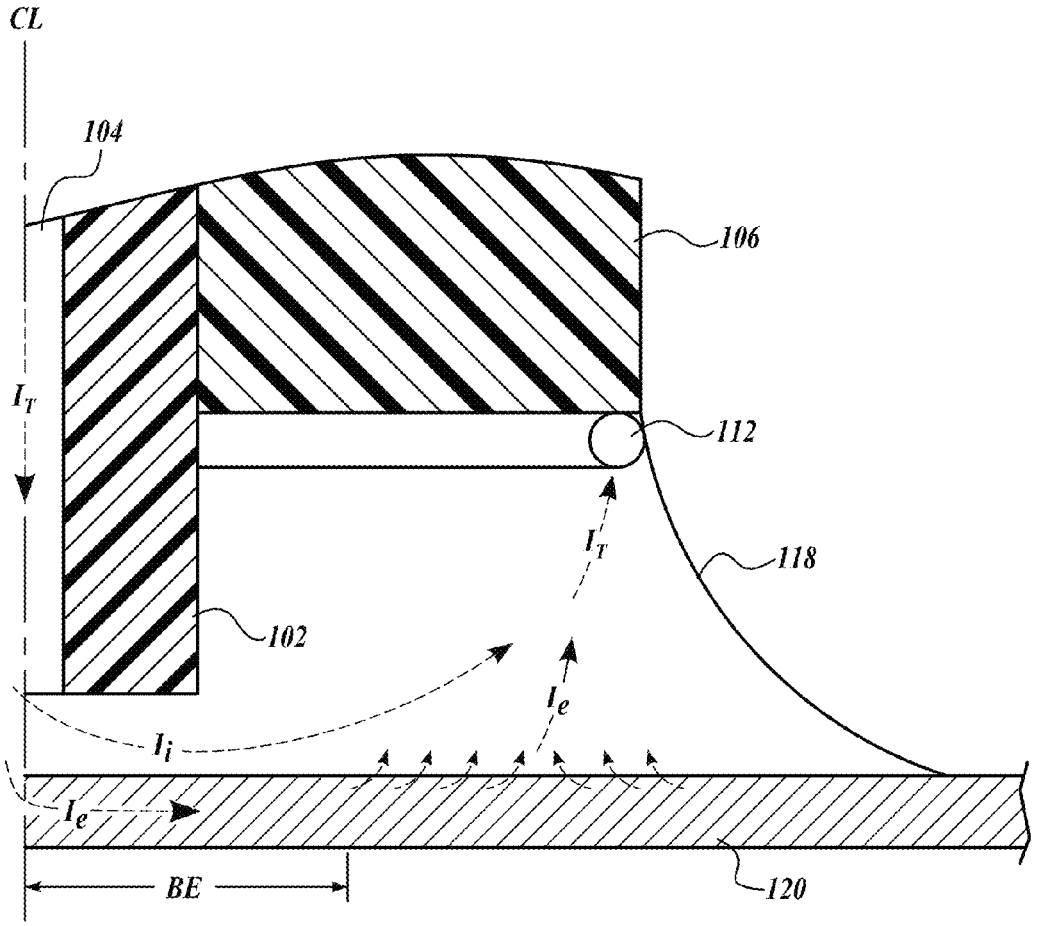
FIG. 1C is a detail view of the printer head shown in FIG. 1A, illustrating the relevant current flow paths.

FIG. 1C illustrates geometry for the printer 100 used in computer simulations. In these simulations FH was set equal to the nozzle diameter d. The relevant current pathways available in the bipolar electrochemical printer 100 are illustrated.

Current in the form of an ionic current passes from the feeder anode 110 (FIG. 1A) through the electrolyte down channel 104 and through the nozzle 101 as indicated by arrow $I_T$ in channel 104. When the ionic current $I_T$ exits the nozzle the current may continue as an ionic current through the electrolyte between the nozzle 101 and the conductive substrate 120 and through the electrolyte 118 pooled below the housing 106 to the cathode 112 as indicated by arrows $I_i$. However, some of the ionic current may undergo charge transfer at the conductive substrate 120 in the region below the nozzle 101, and will then be transported by electrons through the conductive substrate 120, as indicated by arrow $I_e$. This ohmic current $I_e$ will undergo charge transfer again in a region below the cathode 112 (as indicated by the smaller arrows) and will flow through the electrolyte as ionic current to the cathode 112. The current will select the least resistive pathway so it is desirable that our system exhibit a high ohmic resistance through the electrolytic pathway and low charge transfer resistance at the substrate 120 in order to induce polarization in the conductive substrate 120.

It will now be appreciated that if the printer 100 is configured to cause charge transfer at the surface of the conductive substrate 120, a portion of the conductive substrate 120 in the present system becomes polarized, and is functionally a bipolar electrode BE.

The bipolar current efficiency (BCE) is the fraction of total applied current that passes through the bipolar electrode and may therefore be used to define the efficiency of the bipolar electrochemical system:

$$BCE = \frac{I_e}{I_{app}} \tag{1}$$

Application of a large enough potential difference between the feeder electrodes 110, 112 allows for polarization of the conductive substrate 120 and results in simultaneous reduction in the partially cathodic region of the substrate 120 below the nozzle 101 and oxidation in the partially anodic region of the substrate below the cathode 112. The extent of polarization is related to the applied electric field E and length l of the polarized portion:

$$\Delta V = El \tag{2}$$

Reduction and oxidation reactions will occur at the bipolar electrode (to an initial approximation) if the polarization of the bipolar electrode creates a potential difference greater than that of the standard equilibrium potentials of the redox couples. For example, the potential difference for the case of nickel reduction and copper etching of a copper substrate, as indicated in Eqs. 3 and 4 must exceed a minimum of 0.59V. This is considered a first approximation because additional overpotentials due to mass transfer, kinetics, and concentration gradients are ignored. The radial location at which the chemistry switches from reduction to oxidation is defined as the bipolar crossover point (BPX) and is also used to evaluate the bipolar electrochemical traits of the system:

$$Ni^{+2} + 2e^- \rightarrow Ni_{(s)} \quad E_{red}^0 = -0.25\ V \tag{3}$$

$$Cu_{(s)} \rightarrow Cu^{+2} + 2e^- \quad E_{ox}^0 = 0.34\ V \tag{4}$$

COMSOL® was used to evaluate the experimental setup for different controllable geometries and operating conditions. Secondary current distribution computations were performed in the axisymmetric 2D computational domain shown in FIG. 1C. These computations were used to determine the relevant current flow pathways through the electrolyte (denoted $I_i$ in FIG. 1C) and extent of bipolar electrochemistry through the substrate (denoted $I_e$ in FIG. 1C).

A secondary current distribution is appropriate here because the concentration is substantially uniform (limiting current densities can exceed 10 A $cm^{-2}$, so it is reasonable to neglect concentration gradients). For this secondary current distribution problem, Laplace's equation governs the potential distribution (ϕ) in the electrolyte domain:

$$\nabla^2 \phi = 0 \tag{5}$$

The nozzle 101, housing 106, and electrolyte meniscus are treated as insulating boundary conditions:

$$n \cdot \nabla \phi = 0 \tag{6}$$

The boundary condition for the anode 110 at the inlet is given as:

$$-\kappa n \cdot \nabla \varphi = \frac{I_{applied}}{A_{anode}} \tag{7}$$

and the cathode 112 boundary condition is:

$$-\kappa n \cdot \nabla \varphi = \frac{-I_{applied}}{A_{cathode}} \tag{8}$$

where κ is the electrolyte conductivity, $A_{nozzle}$ is the area of the nozzle where the current is applied, and $A_{cathode}$ is the area of the outer ring cathode 112. The reversible (copper) bipolar electrochemistry occurring on the conducting substrate 120 is given by the Butler-Volmer equation:

$$i = i_o\left[e^{\frac{\alpha nF}{RT}\eta_s(r)} - e^{\frac{1(1-\alpha)nF}{RT}\eta_s(r)}\right] \tag{9}$$

where the room temperature parameters for copper are assumed to be $i_o$=3.35 mA $cm^{-2}$, α=0.73, and n=2. The surface overpotential shown in Eq. 9 is:

$$\eta_s = V_s - \phi(r) - E_{eq} \tag{10}$$

where the potential ϕ at the surface is shown explicitly as a function of radial position, while the potential of the conductive substrate $V_s$ and the equilibrium potential $E_{eq}$ are constants. For these simulations, we assume there is a single reversible copper chemistry on the conductive substrate measured with a reference electrode of the same kind (e.g., reversible copper reference), resulting in $E_{eq}$=0, $V_s$=0, and $\eta_s = -\phi(r)$.

The bipolar electrode must have equal and opposite oxidation and reduction reactions to remain charge neutral, which can be expressed by the integral constraint over the area of the electrode:

$$I_{e,net} = 2\pi \int_0^R i_o\left[e^{\frac{\alpha_a nF}{RT}\eta_s(r)} - e^{\frac{-(1-\alpha_a)nF}{RT}\eta_s(r)}\right] r dr = 0. \tag{11}$$

Here, $I_{e,net}$ is the net electronic current passing through the bipolar substrate, which must be zero when integrated over the whole electrode.

In an example embodiment an array of copper deposits were plated onto a copper substrate at a range of conditions. The applied current density was varied from 30 μA to 300 μA and FH was varied from 15 μm to 60 μm. Total charge was also varied along with current density to keep a constant deposition time of five seconds for each deposit. The electrolyte used comprised 0.1M $CuSO_4$ and 0.001M $H_2SO_4$ and the flow rate was constant throughout the experiment at 400 μL/min. In general, the size of the deposition increased with FH, and with applied current. The experiment demonstrated how different operating conditions such as current density and fly height can control the shape and size of each deposit.

Although not intending to be limited by the current understanding of the physics underlying the present invention, the following discussion is provided to aid the reader in understanding the processes disclosed herein.

Corresponding COMSOL® simulations for three different deposits show that nearly all of the applied current at the surface passes through the bipolar electrode BE before the position along the radial axis corresponding to the nozzle exit radius. This indicates that the deposit shape can also be controlled by fabricating different sized microjet nozzles. The location of the bipolar electrode cross-over BPX for these simulations is near the location of the nozzle 101 outer radius (340 μm), i.e., the outer radius of the tube 102. This further demonstrates that nozzle wall thickness can control the location along the radial axis at which reduction switches to oxidation. By integrating current density over the area of the bipolar electrode BE from the center of the nozzle to the BPX the BCE can be calculated for each deposit.

The high current efficiencies establish that the system exhibits a high ohmic resistance through the annular gap beneath the nozzle 101. When the applied current is held constant and FH is decreased a drop in the BCE as well as a shift of the bipolar electrode further away from zero was found. This results from a decrease in the ohmic resistance through the solution when the FH is increased, allowing more of the applied current to pass through the electrolyte, bypassing the substrate. Holding FH constant and increasing the applied current results in a slight improvement of the BCE as well as a small inward shift of the bipolar electrode. This is caused by a decrease in charge transfer resistance due to the higher current density at the surface, which forces more current to pass through the substrate.

Non-uniform deposition is a feature that is intrinsic to both conventional electrochemical printing and bipolar electrochemical printing. Highly localized current density at the substrate surface allows for controlled spot deposition with bipolar electrochemical printing. A Gaussian current density profile results in deposits that have varying plating conditions radially. High magnification scanning electron microscope images were taken at different locations radially within the deposit corresponding to different current densities. These results show that the edge of the deposit plated copper with 40% larger grain sizes than at the center of the deposit where current density is highest. This suggests that each deposit could have radially varying mechanical characteristics. This could also lead to gradient compositions in alloy plating when ions plate at differing potentials.

The dimensionless Wagner number is used to characterize a secondary current distribution electrochemical system. The Wagner number relates the overall charge transfer resistance to the ohmic resistance in the solution. The dominating ohmic resistance in the system is through the annular gap below the nozzle wall and is related to the geometric features of the nozzle through Eq. 12:

$$R_{annular} \sim \frac{\ln(r_o/r_i)}{2\pi\kappa FH} \tag{12}$$

The role of applied current on charge transfer resistance can be represented as:

$$R_{CT,red} \sim \frac{RT}{I_{app}\mathrm{nF}} \tag{13}$$

if one assumes a Tafel kinetic approximation for the high current density reduction region beneath the nozzle. The balancing of these characteristic ohmic and charge transfer resistances are believed to be key to a qualitative understanding of the results.

To generalize the disclosed findings, a dimensionless Wagner number (Wa) is defined that captures the key balance between the annular ohmic resistance and cathodic charge transfer resistances described in Eqs. 12 and 13:

$$Wa = \frac{2\pi RT\kappa H}{I_{app}\mathrm{nFln}(r_o/r_i)} \tag{14}$$

If the applied current followed a simple and uniform parallel splitting of current flow via the ionic vs electronic paths, then the dimensionless BCE would scale with Wa in the following manner:

$$BCE \sim \frac{1}{1+Wa} \tag{15}$$

This relationship is for a single reversible system. When the thermodynamic potential difference of an irreversible couple must be accounted for the system needs to ensure that the potential difference across the bipolar electrode exceeds that of the standard potential difference otherwise surface reactions will not occur. Therefore, we can define a threshold current:

$$I_{min} = \frac{\Delta E_{min}}{R_{annular}} \tag{16}$$

as the minimum current required to overcome the equilibrium potential difference ($\Delta E_{min}$) for a given annular resistance. This is incorporated into the relationship from Eq. 15 by:

$$BCE \sim \frac{1 - I_{min}/I_{app}}{1+Wa} \tag{17}$$

where applied currents less than the minimum threshold current produce unreal values of BCE and BCE=0 when the applied current is equal to the threshold current.

Figure 2A:
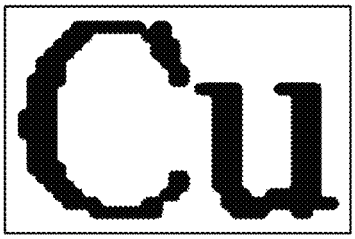
FIGS. 2A and 2B illustrate bitmap images of the elemental symbols for copper and nickel that were used for bipolar electrochemical printing designs.
Figure 2B:
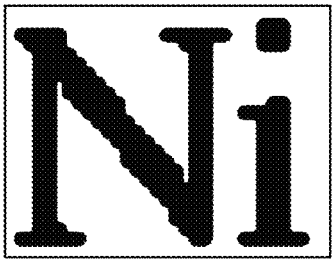
Figure 2C:
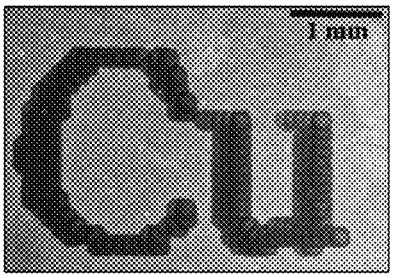
FIG. 2C is an optical micrograph of characters printed in copper on a copper substrate.
Figure 2D:
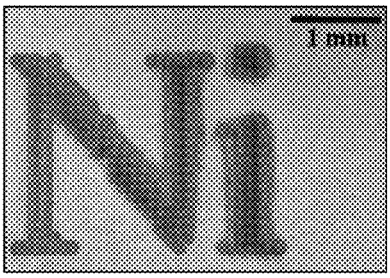
FIG. 2D is an optical micrograph of characters printed in nickel on a copper substrate.

FIGS. 2A and 2B illustrate bitmap images of the elemental symbols for copper and nickel that were used for metallization designs. FIG. 2C depicts an optical micrograph of patterned copper on a copper surface. The electrolyte for this embodiment was composed of 0.1 M $CuSO_4$ and 0.001 M $H_2SO_4$. In this bipolar system, copper ions in solution are reduced to solid copper deposits while the copper substrate is etched. This is an example of a reversible couple that does not have a thermodynamic potential difference. FIG. 2D depicts a similar embodiment with nickel reduced on a copper surface. This presents a case where a thermodynamic potential difference of 0.59V must first be overcome since the standard reduction potentials for copper and nickel are 0.34 and −0.25, respectively. The nickel based electrolyte was composed of 0.3 M $NiSO_4$, 0.014 M sodium acetate, and 0.04 M acetic acid. Both the nickel- and copper-based electrolytes were designed previously for traditional electrochemical printing, yet work well with bipolar electrochemical printing.

Figure 2E:
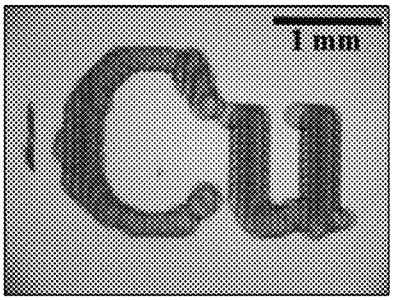
FIG. 2E is an optical micrograph of characters printed in copper on a clean gold substrate.

For micro-patterning applications the oxidation of the copper substrate is an undesirable side effect of the bipolar process. However, a reducing agent may be added to the electrolyte that can undergo oxidation at the substrate surface without modifying the physical properties of the substrate. FIG. 2E depicts an optical micrograph of copper deposited on a clean gold substrate. The reducing agent in this electrolyte is ascorbic acid, which oxidizes at the gold surface when copper ions are reduced. Since the standard reduction potential for ascorbic acid (−0.242V) is much less than that of gold (1.52V), ascorbic acid oxidizes at lower surface overpotentials than gold allowing for copper reduction without etching the gold surface.

Figure 2F:
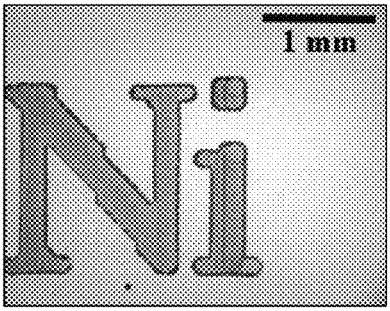
FIG. 2F is an optical micrograph of characters printed in copper on a clean gold substrate surface, each printing performed using a bipolar electrochemical printer in accordance with the present invention.

It is also essential to hold the applied current low enough to keep ascorbic acid oxidation preferential to copper oxidation. At large enough overpotentials copper oxidation becomes favored and the previously deposited copper is removed from the surface. This was repeated for nickel deposition on gold as seen in FIG. 2F. The nickel electrolyte was composed of 0.1 M $NiSO_4$ and 0.01 M ascorbic acid. The thermodynamic potential differences for copper and nickel deposition on a gold substrate with acetic acid oxidation are 0.28V and 0.31V, respectively.

As disclosed above, electrochemical printing combined with bipolar electrochemistry provides a tool capable of remote electrochemistry on a conductive surface. Embodiments of this concept are demonstrated, for example, through electrodeposition micro-patterning of noble copper and ignoble nickel on both sacrificial and inert substrates. This tool was also extended to etching for micro-patterning of a sacrificial substrate, demonstrating the versatility this technique offers. These patterns demonstrate that bipolar electrochemical printing retains the control and practicality of traditional electrochemical printing while introducing the advantage of contactless electrochemistry.

Figure 3:
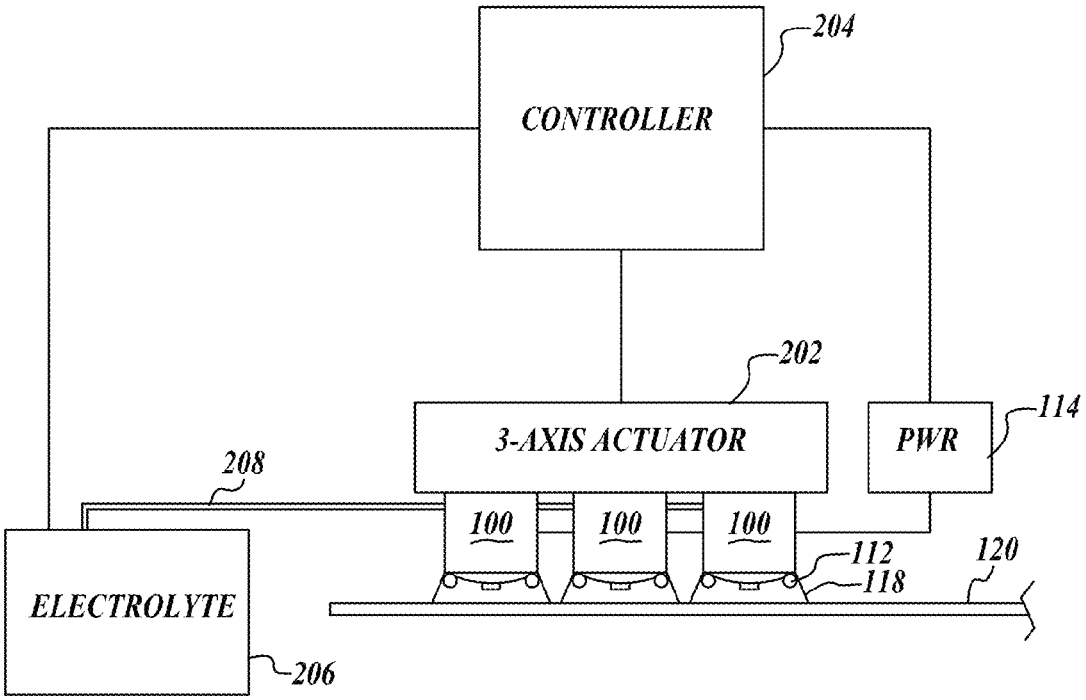
FIG. 3 is a schematic diagram of a printer assembly incorporating a plurality of the printer heads shown in FIG. 1A.

The printer head disclosed above and shown in FIG. 1A may be incorporated into a printing assembly in any convenient manner. FIG. 3 illustrates a printer assembly 200 comprising a plurality (three shown) of bipolar electrochemical printer heads 100 disposed on a 3-axis linear actuator 202. The actuator 202 is connected to a controller 204 that controls movement of the print heads 100 over the substrate 120. The controller 204 may also control the flow rate from a source of electrolyte 206 through a conduit 208 to the print heads 100. It will be appreciated by persons of skill in the art that the print heads 100 may alternatively be controlled in a coordinated by non-uniform mode.

The disclosure herein may be readily extended to scanning remote electrochemistry on more complex substrates, for example, to apply it to applications in the semiconductor industry. This technique may also be extended to other electrochemical processes beyond metallization. For example, addition of a reference electrode located outside of the nozzle tip allows for potential measurements near the surface. These measurements will provide information regarding charge transfer kinetics at the surface and could deliver a technique for rapidly screening electrocatalysts that are spot patterned on a substrate.

Further embodiments include:

- Bipolar electrochemical printers using multi-pixel heads with bipolar electrochemistry.
- Bipolar electrochemical printing using non-aqueous electrolytes, which may have certain advantages due to the lower conductivity that most ionic liquids have, and because solvent degradation effects that occur with aqueous solution may be avoided.
- It will be obvious to persons of skill in the art and from the present disclosure that bipolar electrochemical printing is not limited to deposition onto metals. The technology for electrodeposition of semiconductors, metal oxides, and conductive polymers is known, and the teachings herein for bipolar electrochemical printing may be applied to print or etch any of these materials as well.
- The methods disclosed herein may be applied with different nozzle shapes and is readily scalable. Bipolar electrochemical printing may be scaled down to nanometer-scale to make smaller deposits.
- A multi-pixel nozzle could also be used as a micro-patterned mask that would be able to deposit pixels in a set formation.

The particulars shown herein are by way of example and for purposes of illustrative discussion of the preferred embodiments of the present invention only and are presented in the cause of providing what is believed to be the most useful and readily understood description of the principles and conceptual aspects of various embodiments of the invention. In this regard, no attempt is made to show structural details of the invention in more detail than is necessary for the fundamental understanding of the invention, the description taken with the drawings and/or examples making apparent to those skilled in the art how the several forms of the invention may be embodied in practice.

The embodiments of the invention in which an exclusive property or privilege is claimed are defined as follows:

1. A bipolar electrochemical printer head for printing or etching a conductive substrate comprising:

a tubular nozzle comprising an annular wall defining a channel, wherein the channel has an inlet configured to be connected to a source of electrolyte and an outlet configured to be supported in spaced relation over the conductive substrate during use;

a housing attached to the nozzle having a lower end that surrounds and extends away from the nozzle;

a first electrode comprising one of an anode and a cathode, and a second electrode comprising the other of the anode and the cathode, wherein the first electrode extends into the channel and the second electrode is supported on the housing and is spaced radially away from the tubular nozzle and located a distance above the channel outlet such that the second electrode is positioned farther from the conductive substrate than the channel outlet during use, and wherein the second electrode is disposed outside of the housing; and a power supply electrically connecting the first electrode to the second electrode;

wherein the second electrode is positioned to fluidly engage a meniscus of electrolyte that is expelled from the channel outlet onto the conductive substrate when the channel outlet is positioned within a predetermined distance above the conductive substrate such that the electrolyte closes a circuit between the first electrode, the second electrode, and the power supply.

2. The bipolar electrochemical printer head of claim 1, wherein the lower end of the housing is disposed at an elevation above the channel outlet.

3. The bipolar electrochemical printer head of claim 2, wherein the lower end of the housing is disposed less than 3 mm above the channel outlet.

4. The bipolar electrochemical printer head of claim 1, wherein the first electrode is the anode and the second electrode is the cathode.

5. The bipolar electrochemical printer head of claim 4, wherein the second electrode defines a substantially circular loop that is centered on the channel.

6. The bipolar electrochemical printer head of claim 4, wherein the channel outlet is circular with an exit diameter and the tubular nozzle wall has a thickness that is greater than the exit diameter.

7. The bipolar electrochemical printer head of claim 6, wherein the exit diameter is less than 1 mm.

8. The bipolar electrochemical printer head of claim 7, wherein the wall thickness is less than 3 mm.

9. The bipolar electrochemical printer head of claim 6, wherein the exit diameter is at least 200 μm and the wall thickness is at least 240 μm.

10. The bipolar electrochemical printer head of claim 1, wherein the printer head is configured to be positioned over the conductive substrate at a distance that will cause ionic current in the electrolyte to undergo charge transfer at the conductive substrate between the tubular nozzle and the conductive substrate.

* * * * *